US009498981B2

(12) United States Patent
Otake

(10) Patent No.: US 9,498,981 B2
(45) Date of Patent: Nov. 22, 2016

(54) PRINTED MATERIAL PROCESSING METHOD, PRINTED MATERIAL PROCESSING APPARATUS, AND IMAGE FORMING APPARATUS

(71) Applicant: SEIKO EPSON CORPORATION, Tokyo (JP)

(72) Inventor: Masahisa Otake, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 14/566,295

(22) Filed: Dec. 10, 2014

(65) Prior Publication Data

US 2015/0174919 A1 Jun. 25, 2015

(30) Foreign Application Priority Data

Dec. 24, 2013 (JP) ..... 2013-265001

(51) Int. Cl.
*B41J 11/66* (2006.01)
*B41J 11/00* (2006.01)
*B41M 7/00* (2006.01)

(52) U.S. Cl.
CPC ..... *B41J 11/66* (2013.01); *B41J 11/002* (2013.01); *B41M 7/0081* (2013.01)

(58) Field of Classification Search
CPC ..... B41J 11/002; B41J 11/0015; B41J 2/01; B41J 11/66; B41M 7/0072; B41M 7/0081; C09D 11/101
See application file for complete search history.

(56) References Cited

U.S. PATENT DOCUMENTS

| | | | | |
|---|---|---|---|---|
| 7,182,008 | B2 * | 2/2007 | Negishi | B26D 1/0006 83/15 |
| 2004/0024078 | A1 * | 2/2004 | Itoh et al. | 522/1 |
| 2009/0068418 | A1 | 3/2009 | Iwase et al. | |
| 2010/0086339 | A1 * | 4/2010 | Levy | B41J 2/17593 400/621 |
| 2010/0097434 | A1 * | 4/2010 | Rabbani et al. | 347/104 |
| 2010/0165041 | A1 * | 7/2010 | Sugahara | B41J 2/16532 347/36 |
| 2012/0268538 | A1 * | 10/2012 | Kondo et al. | 347/102 |

FOREIGN PATENT DOCUMENTS

| | | | |
|---|---|---|---|
| JP | 05-154795 | A | 6/1993 |
| JP | 05-245933 | A | 9/1993 |
| JP | 09-015871 | A | 1/1997 |
| JP | 09-248799 | A | 9/1997 |
| JP | 2004-302145 | A | 10/2004 |
| JP | 2009-096043 | A | 5/2009 |

* cited by examiner

*Primary Examiner* — Justin Seo
(74) *Attorney, Agent, or Firm* — Global IP Counselors, LLP

(57) ABSTRACT

A processing apparatus is configured to process printed material where a printed layer is formed on a printing medium (a substrate) using an ultraviolet curable material, and is provided with a blade which is configured to process the printed material, a heater unit which is configured to heat the blade, and a first control section (a processing control section) which is configured to control the heater unit. The first control section is configured to previously heat the blade to a predetermined temperature according to a glass transition point of the ultraviolet curable material using the heater unit before the processing is performed.

13 Claims, 3 Drawing Sheets

Fig. 3A
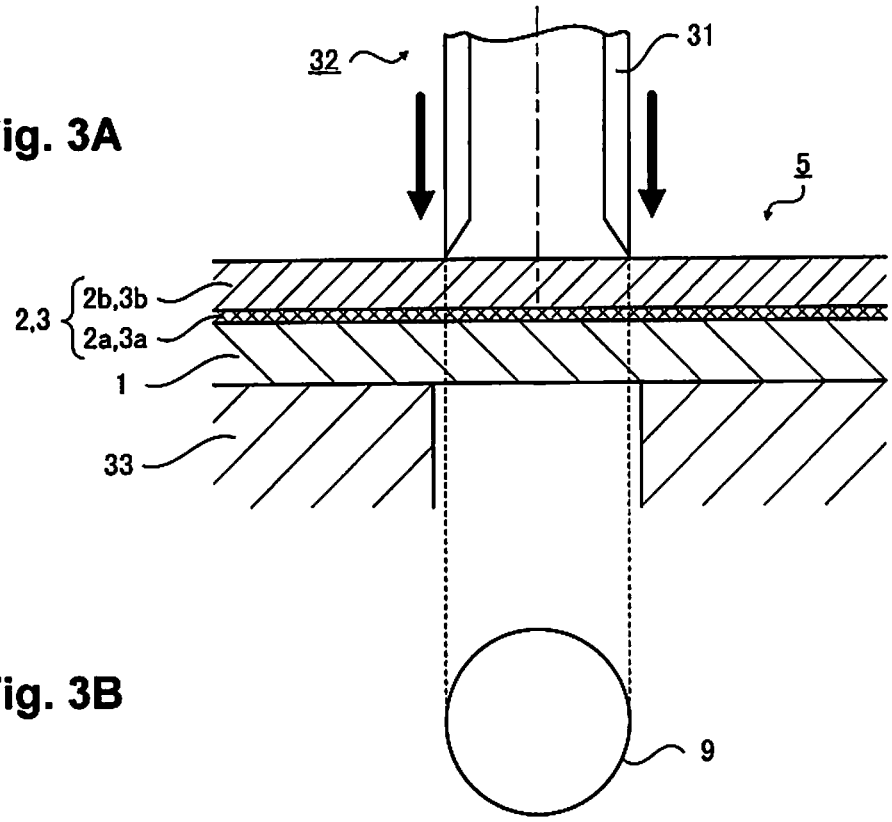
Fig. 3B
Fig. 3C
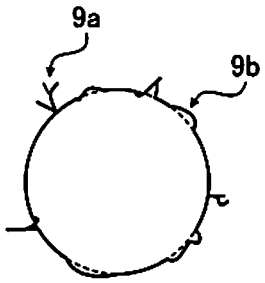

Fig. 4A
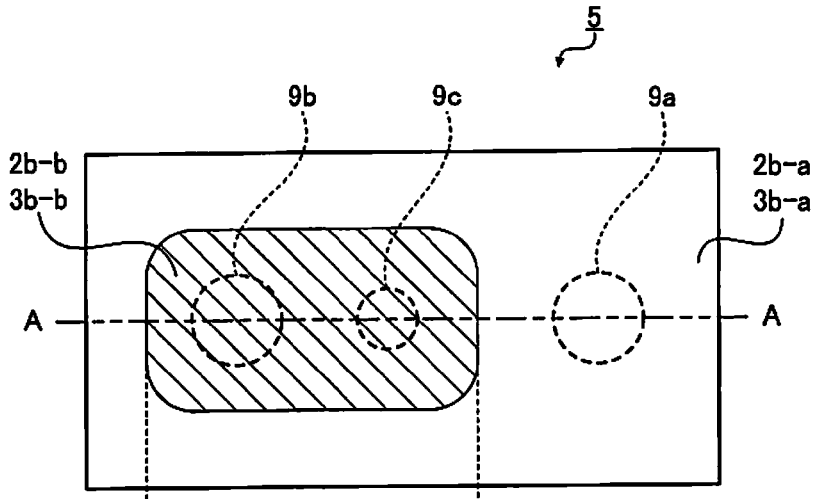
Fig. 4B
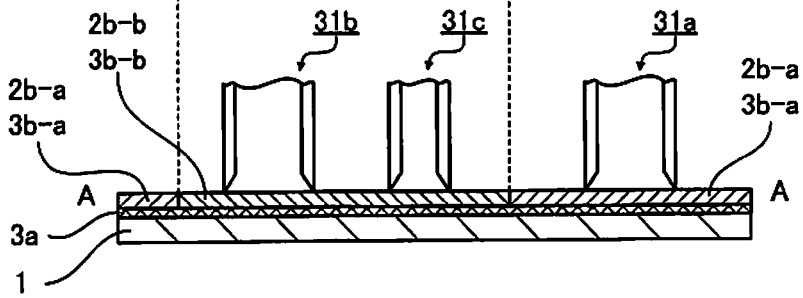
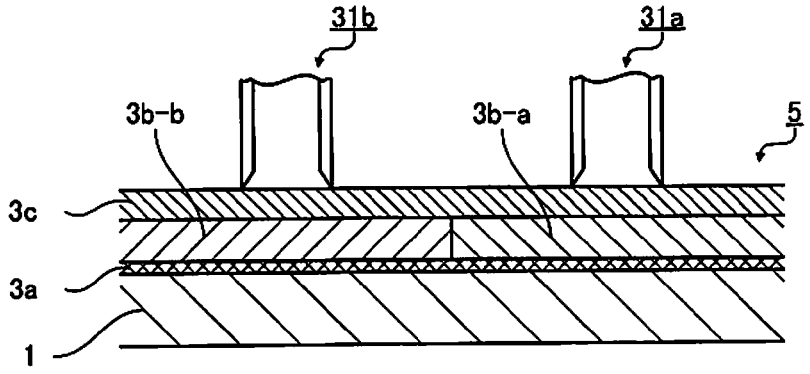
Fig. 5

PRINTED MATERIAL PROCESSING METHOD, PRINTED MATERIAL PROCESSING APPARATUS, AND IMAGE FORMING APPARATUS

CROSS-REFERENCE TO RELATED APPLICATIONS

This application claims priority to Japanese Patent Application No. 2013-265001 filed on Dec. 24, 2013. The entire disclosure of Japanese Patent Application No. 2013-265001 is hereby incorporated herein by reference.

BACKGROUND

1. Technical Field

The present invention relates to a printed material processing method, a printed material processing apparatus, and an imaging forming apparatus.

2. Related Art

The use of ink jet printers is spreading in a wide range of fields with industrial applications since recording of precision digital color images is easy. For example, components and processed materials, where an image is formed (printed) on a surface in advance using an ink jet printer, are used in processing and manufacturing lines for products with various designs and various colorings.

In manufacturing processes where such components and processed materials are used, there are cases where, for example, damage is imparted on a printed layer at a processing location such as a punching blade or a cutting blade which are used in processing. In contrast to this, a method is described, for example, in Japanese Unexamined Patent Application Publication No. 2009-96043 where UV ink with low hardness is used in images which are formed at processing locations in order to prevent cracks being generated in the printed layer (a layer of UV ink which is cured) at the processing location.

However, in the method described in Japanese Unexamined Patent Application Publication No. 2009-96043, it is necessary for UV inks where the hardness is different to be prepared for each color of UV ink which is to be used and it is necessary for an image forming apparatus such as an ink jet printer to be provided with discharge heads which are different in order to discharge the UV inks. For this reason, there is a problem in that the cost of the apparatus increases and the size of the apparatus becomes larger. In addition, there are problems in that slight differences occur in the coloring of images which are formed due to differences in the composition of the UV ink where the hardness is different even with UV inks of the same colors, the differences are particularly pronounced at interface sections, and printing quality is reduced.

SUMMARY

The present invention is carried out in order to solve at least a portion of the problems described above and is able to be realized as the following applied examples and aspects.

A printed material processing method according to the present applied example comprising performing a processing by using a blade on a printed material where a printed layer is formed on a printing medium using an ultraviolet curable material and heating the blade before performing the processing.

According to the present applied example, since the blade, which processes the printed material where the printed layer is formed on the printing medium using the ultraviolet curable material, is heated before performing the processing, the processing interface is softened due to heat energy which is transferred due to the blade abutting against the printed layer during processing. For this reason, damage which is imparted onto the fracture surface of the printed layer due to processing is reduced and cracking, chipping, peeling, and the like of the printed layer at the processing location is suppressed. As a result, it is possible to, for example, suppress reductions in processing quality without using ultraviolet curable materials (UV ink) where the hardness is different and without inviting increases in the costs or size of the image forming apparatus or reductions in printing quality.

In the printed material processing method according to the applied example described above, the blade is previously heated to a predetermined temperature Tc (° C.) according to a glass transition point of the ultraviolet curable material before the performing of the processing.

According to the present applied example, since the blade, which processes the printed material where the printed layer is formed on the printing medium using the ultraviolet curable material, is previously heated to a predetermined temperature according to the glass transition point of the ultraviolet curable material, it is possible to more appropriately soften the processing interface due to heat energy which is transferred due to the blade abutting against the printed layer during processing. For this reason, damage which is imparted onto the fracture surface of the printed layer due to processing is reduced and cracking, chipping, peeling, and the like of the printed layer at the processing location is suppressed. As a result, it is possible to, for example, suppress reductions in processing quality without using UV inks where the hardness is different and without inviting increases in the costs or size of the image forming apparatus or reductions in printing quality.

In the printed material processing method according to the applied example described above, the glass transition point is the glass transition point of the ultraviolet curable material on an uppermost layer which forms the printed layer.

According to the present applied example, since the blade, which processes the printed material where the printed layer is formed on the printing medium using the ultraviolet curable material, is previously heated to a predetermined temperature according to the glass transition point of the ultraviolet curable material on the uppermost layer which configures the printed layer, the processing interface on the uppermost surface is softened due to heat energy which is transferred due to the blade abutting against the printed layer. For this reason, damage which is imparted onto the processing interface of the uppermost layer due to processing is reduced. As a result, the extent of damage to the printed layer at an inner section due to damage to the processing interface on the uppermost surface being a trigger is suppressed.

A printed material processing method according to the present applied example comprises performing a processing by a using a blade on printed material where a printed layer is formed on a printing medium using an image forming material and previously heating the blade to a predetermined temperature Tc (° C.) according to a glass transition point of the image forming material before the performing of the processing.

According to the present applied example, since the blade, which processes the printed material where a printed layer is formed, is previously heated to a predetermined temperature according to the glass transition point of the image forming material, the processing interface is softened due to heat energy which is transferred due to the blade abutting against the printed layer during processing. For this reason, damage which is imparted onto the fracture surface of the printed layer due to processing is reduced and cracking, chipping, peeling, and the like of the printed layer at the processing location is suppressed. As a result, it is possible to, for example, suppress reductions in processing quality without using UV ink where the hardness is different and without inviting increases in the costs or size of the image forming apparatus or reductions in printing quality.

In the printed material processing method according to the applied example described above, the glass transition point of the image forming material is the glass transition point of the image forming material on an uppermost layer which forms the printed layer.

According to the present applied example, since the blade, which processes the printed material where a printed layer is formed, is previously heated to a predetermined temperature according to the glass transition point of the image forming material on the uppermost layer which configures the printed layer, the processing interface on the uppermost surface is softened due to heat energy which is transferred due to the blade abutting against the printed layer. For this reason, damage which is imparted onto the processing interface of the uppermost layer due to processing is reduced. As a result, the extent of damage to the printed layer at an inner section due to damage to the processing interface on the uppermost surface is suppressed.

In the printed material processing method according to the applied example described above, it is preferable that, when the glass transition point is Tg (° C.), the predetermined temperature Tc (° C.) is $Tg-40° C. < Tc < Tg+10° C.$ Due to $Tg-40° C. < Tc < Tg+10° C.$ as in present applied example, damage which is imparted to the fracture surface of the printed layer due to processing is further reduced.

In the printed material processing method according to the applied example described above, it is preferable that, when the glass transition point is Tg (° C.), the predetermined temperature Tc (° C.) is $Tg-10° C. < Tc < Tg+3° C.$ Due to $Tg-10° C. < Tc < Tg+3° C.$ as in present applied example, damage which is imparted to the fracture surface of the printed layer due to processing is further reduced.

In the printed material processing method according to the applied example described above, the printed layer is previously heated to a temperature which is less than the glass transition point before the performing of the processing.

Due to previously heating the printed layer to a temperature which is less than the glass transition point of the image forming material as in present applied example, it is possible to soften the processing surface which abuts against the blade in a shorter period of time. As a result, it is possible to shorten the period of time over which the blade which is heated is abutting against the printed layer, that is, the processing time. In other words, it is possible to reduce damage on the fracture surface of the printed layer and to suppress cracking, chipping, peeling, and the like of the printed layer being generated at the processing location even in a case where the processing is performed at a faster speed.

A printed material processing apparatus according to the present applied example is configured to process printed material where a printed layer is formed on a printing medium using an ultraviolet curable material, and comprises a blade configured to perform a processing of the printed material, a first heating section configured to heat the blade, and a first control section configured to control the first heating section. The first control section is further configured to heat the blade using the first heating section before the processing is performed.

According to the present applied example, the processing apparatus is provided with the blade which is able to process the printed material, the first heating section which is able to heat the blade, and the first control section which is able to control the first heating section. Since the first control section previously heats the blade before the processing is performed, the processing interface is softened due to heat energy which is transferred due to the blade abutting against the printed layer during processing. For this reason, damage which is imparted onto the fracture surface of the printed layer due to processing is reduced and cracking, chipping, peeling, and the like of the printed layer at the processing location is suppressed. As a result, it is possible to, for example, suppress reductions in processing quality without using ultraviolet curable materials (UV ink) where the hardness is different and without inviting increases in the costs or size of the image forming apparatus or reductions in printing quality.

In the printed material processing apparatus according to the applied example described above, the blade is previously heated to a predetermined temperature Tc (° C.) according to a glass transition point of the ultraviolet curable material before the processing is performed.

According to the present applied example, since the first control section previously heats the blade, which processes the printed material where the printed layer is formed on the printing medium using the ultraviolet curable material, to a predetermined temperature according to the glass transition point of the ultraviolet curable material before performing the processing, it is possible to more appropriately soften the processing interface due to heat energy which is transferred due to the blade abutting against the printed layer during processing. For this reason, damage which is imparted onto the fracture surface of the printed layer due to processing is reduced and cracking, chipping, peeling, and the like of the printed layer at the processing location is suppressed. As a result, it is possible to, for example, suppress reductions in processing quality without using ultraviolet curable materials (UV ink) where the hardness is different and without inviting increases in the costs or size of the image forming apparatus or reductions in printing quality.

A printed material processing apparatus according to the present applied example is configured to process printed material where a printed layer is formed on a printing medium using an image forming material, and comprises a blade configured to perform a processing of the printed material, a first heating section configured to heat the blade, and a first control section configured to control the first heating section. The first control section is further configured to previously heat the blade to a predetermined temperature according to a glass transition point of the image forming material using the first heating section before the processing is performed.

According to the present applied example, the processing apparatus is provided with the blade which is able to process the printed material, the first heating section which is able to heat the blade, and the first control section which is able to control the first heating section. Since the first control section previously heats the blade to a predetermined temperature according to the glass transition point of the image forming material before performing the processing, the processing interface is softened due to heat energy which is transferred due to the blade abutting against the printed layer during processing. For this reason, damage which is imparted onto the fracture surface of the printed layer due to processing is reduced and cracking, chipping, peeling, and the like of the printed layer at the processing location is suppressed. As a result, it is possible to, for example, suppress reductions in processing quality without using UV inks where the hardness is different and without inviting increases in the costs or size of the image forming apparatus or reductions in printing quality.

The printed material processing apparatus according to the applied example described above further comprises a second heating section configured to heat the printed layer and a second control section configured to control the second heating section. The second control section is further configured to previously heat the printed layer to a temperature which is less than the glass transition point using the second heating section before the processing is performed.

According to the present applied example, the processing apparatus is further provided with the second heating section which is able to heat the printed layer and the second control section which is able to control the second heating section. The second control section previously heats the printed layer to a temperature which is less than the glass transition point of the image forming material using the second heating section before the processing is performed. For this reason, it is possible to soften the processing surface which abuts against the blade in a shorter period of time. As a result, it is possible to shorten the period of time over which the blade which is heated is abutting against the printed layer, that is, the processing time. In other words, it is possible to reduce damage which is imparted onto the fracture surface of the printed layer and to suppress cracking, chipping, peeling, and the like of the printed layer being generated at the processing location even in a case where the processing is performed at a faster speed.

An image forming apparatus according to the present applied example comprises a printing section configured to form a printed layer on a printing medium using an ultraviolet curable material, a blade configured to perform a processing of the printing medium where the printed layer is formed, a first heating section configured to heat the blade, and a first control section configured to control the first heating section. The first control section is configured to heat the blade before the processing is performed.

According to the present applied example, the image forming apparatus is provided with the printing section which is able to form the printed layer on the printing medium using the ultraviolet curable material, the blade which is able to process the printing medium (printed material) where the printed layer is formed, the first heating section which is able to heat the blade, and the first control section which is able to control the first heating section. That is, it is possible for the image forming apparatus to perform not only printing on the printing medium but also perform processing of the printed material which is printed on the printing medium.

In addition, since the first control section previously heats the blade before the processing is performed, the processing interface is softened due to heat energy which is transferred due to the blade abutting against the printed layer during processing. For this reason, damage which is imparted onto the fracture surface of the printed layer due to processing is reduced and cracking, chipping, peeling, and the like of the printed layer at the processing location is suppressed.

That is, according to the present applied example, it is possible to provide the image forming apparatus which is smaller in size and where reductions in product quality of the printed layer due to processing is suppressed.

In the image forming apparatus according to the applied example described above, the blade is previously heated to a predetermined temperature Tc (° C.) according to a glass transition point of the ultraviolet curable material before the processing is performed.

According to the present applied example, since the first control section previously heats the blade to a predetermined temperature according to the glass transition point of the ultraviolet curable material before performing the processing, it is possible to more appropriately soften the processing interface due to heat energy which is transferred due to the blade abutting against the printed layer during processing. For this reason, damage which is imparted onto the fracture surface of the printed layer due to processing is reduced and cracking, chipping, peeling, and the like of the printed layer at the processing location is suppressed.

The image forming apparatus according to the applied example described above further comprises a second heating section configured to heat the printed layer and a second control section configured to control the second heating section. The second control section is further configured to previously heat the printed layer to a temperature which is less than the glass transition point before the processing is performed.

According to the present applied example, the image forming apparatus is further provided with the second heating section which is able to heat the printed layer and the second control section which is able to control the second heating section. The second control section previously heats the printed layer to a temperature which is less than the glass transition point of the ultraviolet curable material before the processing is performed. For this reason, it is possible to soften the processing surface which abuts against the blade in a shorter period of time. As a result, it is possible to shorten the period of time over which the blade which is heated is abutting against the printed layer, that is, the processing time. In other words, it is possible to reduce damage which is imparted onto the fracture surface of the printed layer and to suppress cracking, chipping, peeling, and the like of the printed layer being generated at the processing location even in a case where the processing is performed at a faster speed.

An image forming apparatus according to the present applied example comprises a printing section configured to form a printed layer on a printing medium using an image forming material, a blade configured to perform a processing of the printing medium where the printed layer is formed, a first heating section configured to heat the blade, and a first control section configured to control the first heating section. The first control section is further configured to previously heat the blade to a predetermined temperature according to a glass transition point of the image forming material before the processing is performed.

According to the present applied example, the image forming apparatus is provided with the printing section which is able to form the printed layer on the printing medium using the image forming material, the blade which is able to process the printing medium (printed material) where the printed layer is formed, the first heating section which is able to heat the blade, and the first control section which is able to control the first heating section. That is, it is possible for the image forming apparatus to perform not only printing on the printing medium but also perform processing of the printed material which is printed on the printing medium.

In addition, since the first control section previously heats the blade to a predetermined temperature according to a glass transition point of the image forming material before the processing is performed, the processing interface is softened due to heat energy which is transferred due to the blade abutting against the printed layer during processing. For this reason, damage which is imparted onto the fracture surface of the printed layer due to processing is reduced and cracking, chipping, peeling, and the like of the printed layer at the processing location is suppressed.

That is, according to the present applied example, it is possible to provide the image forming apparatus which is smaller in size and where reductions in product quality of the printed layer due to processing is suppressed.

The image forming apparatus according to the applied example described above further comprises a second heating section configured to heat the printed layer and a second control section configured to control the second heating section. The second control section is further configured to previously heat the printed layer to a temperature which is less than the glass transition point of the image forming material before the processing is performed.

According to the present applied example, the image forming apparatus is further provided with the second heating section which is able to heat the printed layer and the second control section which is able to control the second heating section. The second control section previously heats the printed layer to a temperature which is less than the glass transition point of the image forming material before the processing is performed. For this reason, it is possible to soften the processing surface which abuts against the blade in a shorter period of time. As a result, it is possible to shorten the period of time over which the blade which is heated is abutting against the printed layer, that is, the processing time. In other words, it is possible to reduce damage which is imparted onto the fracture surface of the printed layer and to suppress cracking, chipping, peeling, and the like of the printed layer being generated at the processing location even in a case where the processing is performed at a faster speed.

BRIEF DESCRIPTION OF THE DRAWINGS

Referring now to the attached drawings which form a part of this original disclosure:

FIG. 3A is a cross sectional diagram of printed material illustrating circumstances where hole opening processing is performed on the printed material using a blade;

FIG. 3B is a planar diagram of a punch hole;

FIG. 3C is a planar diagram illustrating cracks and chips which is generated in the punch hole;

FIG. 4A is a planar diagram illustrating a case where a printed layer is formed using UV ink where the compositions are different;

FIG. 4B is a cross sectional diagram illustrating the case where the printed layer is formed using UV ink where the compositions are different; and FIG. 5 is a cross sectional diagram illustrating a case where a printed layer is formed using three layers.

DETAILED DESCRIPTION OF EXEMPLARY EMBODIMENTS

Embodiments which incorporate the present invention will be described below with reference to the drawings. Below are embodiments of the present invention and do not limit the present invention. Here, there are cases in each of the following diagrams where dimensions are drawn to be different to the actual dimensions in order to for the description to be easy to understand.

Embodiment 1

Image Forming Apparatus

Figure 1:
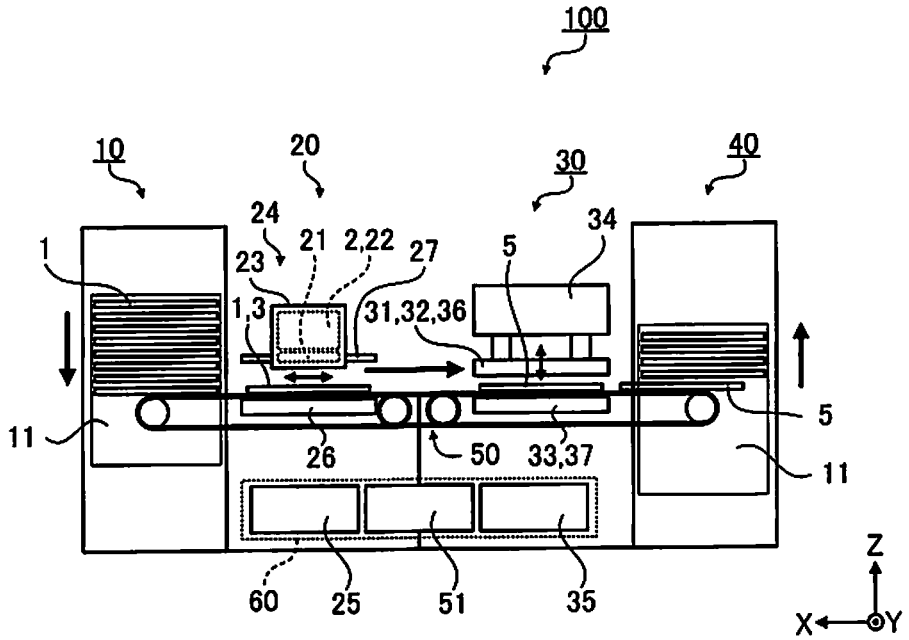
FIG. 1 is a front surface diagram schematically illustrating an image forming apparatus according to an embodiment 1.

FIG. 1 is a front surface diagram schematically illustrating an image forming apparatus 100 according to embodiment 1.

In FIG. 1, the Z axis direction is the up and down direction and the −Z direction is the vertical direction, the Y axis direction is the front and back direction and the +Y axis direction is the front direction, the X axis direction is the left and right direction and the +X axis direction is the left direction, and the X-Y plane is a surface which is parallel to the surface where the image forming apparatus 100 is disposed.

The image forming apparatus 100 is an apparatus which applies an ultraviolet curable material (an ultraviolet curable ink (referred to below as UV ink 2)) which is an image forming material onto a surface of a substrate 1 which is a printing medium, forms a printed layer 3 by drawing out an image, and performs necessary processing such as opening holes in the substrate 1 (referred to below as printed material 5) where the printed layer 3 is formed. A plate or film, which is formed from resin, paper, metal, wood, or the like with a higher glass transition point than the UV ink 2 where the melting point is where the polymerization is complete, is used as the substrate 1.

The image forming apparatus 100 is provided with a substrate supplying section 10, a printing section 20, a substrate processing section 30, a substrate accommodating section 40, a transport mechanism 50, and the like.

The substrate supplying section 10 is positioned on an edge section on the X side of the image forming apparatus 100 as shown in FIG. 1 and is provided with a rotor (which is not shown in the diagrams), which takes out one of the substrates 1 at a time from a cassette 11 which accommodates the substrate 1 and sends out the substrate 1 to the transport mechanism 50.

The printing section 20 is a portion which forms the printed layer 3 by applying (drawing with) the UV ink 2 on a surface of the substrate 1 and is arranged on the −X side of the substrate supplying section 10. The printing section 20 is provided with a discharge head 21, a cartridge loading section 22, a carriage 23, a carriage moving mechanism 24 (the configuration of which is not shown in the diagrams), a printing control section 25, a drawing stage 26, and a UV irradiating unit 27 which is an irradiating section.

The substrate 1, which is sent out from the substrate supplying section 10 using the transport mechanism 50, is set in a predetermined position on the drawing stage 26 by a position alignment mechanism (which is not shown in the diagrams) on the drawing stage 26.

The discharge head 21 is provided with a nozzle (which is not shown in the diagrams) which discharges the UV ink 2 using an ink jet system onto the substrate 1 which is on the drawing stage 26.

The cartridge loading section 22 is loaded with an ink cartridge which accommodates the UV ink 2 and the UV ink 2 is supplied to the discharge head 21.

The carriage 23 is mounted with the discharge head 21 and the carriage loading section 22 (the ink cartridge) and moves over the upper surface of the substrate 1 which is on the drawing stage 26 due to the cartridge moving mechanism 24.

The carriage moving mechanism 24 has an X-Y axis linear transporting mechanism and moves (scans) the carriage 23 over the X-Y plane.

The printing section 20 forms a desired image using the UV ink 2 on the substrate 1 which is set on the drawing stage 26 due to controlling using the printing control section 25. In detail, the printing control section 25 has design image information which is input in advance, controls the position to which the discharge head 21 is moved and the timing with which the UV ink 2 is discharged according to the image information, and forms the printed layer 3 which has the desired image by applying the UV ink 2 at the corresponding positions.

The UV irradiating unit 27 is an ultraviolet irradiating unit which cures the UV ink 2 (the printed layer 3) which is applied onto the substrate 1.

The substrate processing section 30 is a portion which performs the necessary processing such as opening holes in the substrate 1 (the printed material 5) where the printed layer 3 is formed using the printing section 20 and is arranged on the −X side of the printing section 20. The substrate processing section 30 is provided with an upper punching die 32 which is provided with a blade 31, a lower punching die 33 which supports the substrate 1 from below, a pressing mechanism which presses the upper punching die 32 into the substrate 1, a processing control section 35, and the like.

The blade 31 is a punching blade which punches out a desired shape or which punches out a hole with a desired shape by abutting with and being pressed into the substrate 1 and is provided at the lower surface of the upper punching die 32.

A heater unit 36 which is a first heating section which is able to heat the blade 31 is provided in the upper punching die 32.

The lower punching die 33 is arranged below the upper punching die 32 and has a position alignment mechanism for the substrate 1 (the printed material 5). The lower punching die 33 supports the substrate 1 at a predetermined position between itself and the upper punching die 32 which is pressed by the pressing mechanism 34. In addition, the lower punching die 33 is provided with a heater unit 37 which is a second heating section which is able to heat the substrate 1 (the printed layer 3).

The processing control section 35 performs drive control of the pressing mechanism 34 and temperature control of the heater units 36 and 37. That is, the processing control section 35 has the combined functions as a first control section and a second control section.

The processing control section 35 previously heats the blade 31 to a predetermined temperature according to the glass transition point of the UV ink 2 using the heater unit 36 before processing is performed. In addition, the processing control section 35 previously heats the substrate 1 (the printed layer 3) to a temperature which is less than the glass transition point of the UV ink 2 and to a temperature which is less than the melting point of the substrate 1 using the heater unit 37 before processing is performed.

The substrate accommodating section 40 is positioned on an edge section on the −X side of the image forming apparatus 100 and is provided with an unloader (which is not shown in the diagrams) which receives one of the substrate 1 at a time from the transport mechanism 50 in a cassette 11 which accommodates the substrate 1.

The transport mechanism 50 has a function of transporting the substrate 1 which is taken out from the substrate supplying section 10 to the printing section 20, the substrate processing section 30, and the substrate accommodating section 40 in this order and controlling of the transporting is performed by a transport control section 51.

Here, the printing control section 25, the processing control section 35 (including the first control section and the second control section), and the transport control section 51 may have a configuration of centralized control using, for example, a personal computer 60 as shown in FIG. 1 without being provided separately.

Embodiment 2

Printed Material Processing Apparatus

Next, a processing apparatus 200 which is a printed material processing apparatus according to embodiment 2 will be described next. Here, the same reference numerals will be used for the same configuring elements as the embodiment described above in the description and overlapping description is omitted.

Figure 2:
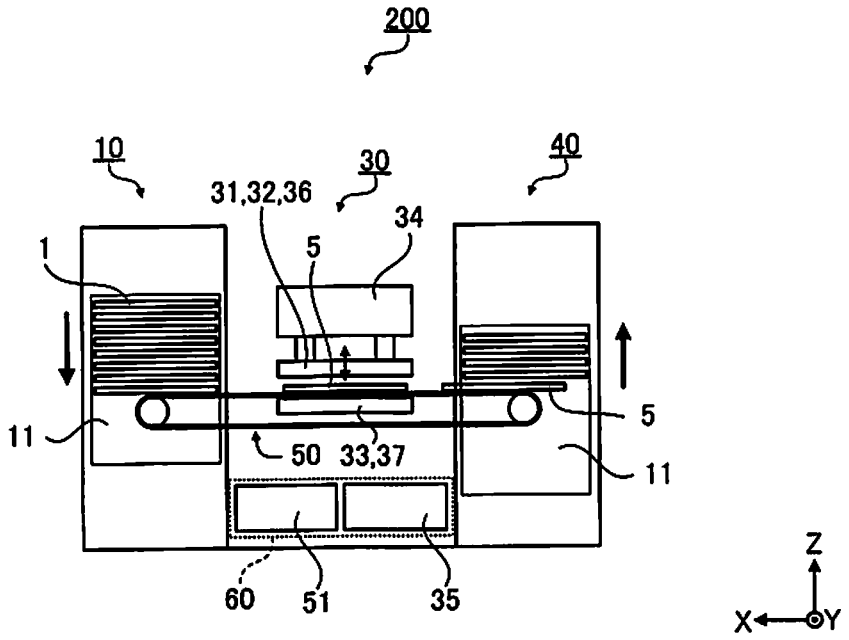
FIG. 2 is a front surface diagram schematically illustrating a printed material processing apparatus according to an embodiment 2.

FIG. 2 is a front surface diagram schematically illustrating the processing apparatus 200.

In the same manner as FIG. 1, in FIG. 2, the Z axis direction is the up and down direction and the −Z direction is the vertical direction, the Y axis direction is the front and back direction and the +Y axis direction is the front direction, the X axis direction is the left and right direction and the +X axis direction is the left direction, and the X-Y plane is a surface which is parallel to the surface where the processing apparatus 200 is disposed.

The processing apparatus 200 is a processing apparatus which processes the printed material 5. The processing apparatus 200 is configured as an apparatus which performs only processing on the printed material 5 in a case where a printing process (a process for forming the printed layer 3 on a surface of the substrate 1 using the UV ink 2) is performed using another apparatus at, for example, a different factory or a different manufacturing line. That is, the processing apparatus 200 is a processing apparatus with a configuration where the printing section 20 is omitted from the image forming apparatus 100 and is configured by the substrate supplying section 10, the substrate processing section 30, the substrate accommodating section 40, the transport mechanism 50, and the like.

Since the processing apparatus 200 has a configuration where the printing section 20 is omitted from the image forming apparatus 100, the transport mechanism 50 transports the substrate 1 which is taken out from the substrate supplying section 10 to the substrate processing section 30 and the substrate accommodating section 40 in this order. In addition, the processing control section 35 (including the first control section and the second control section) and the transport control section 51 may have a configuration of centralized control in a case of centralized control using, for example, a personal computer 60. The other configurations are the same as the image forming apparatus 100.

Here, the substrate processing section 30 which is provided in the image forming apparatus 100 and the processing apparatus 200 is described as a portion which performs punching processing using the blade 31 but the substrate processing section 30 is not limited to punching processing. The substrate processing section 30 may carry out, for example, processing such as cutting or stamping as the processing which is performed by abutting a blade against the printed layer 3.

Embodiment 3

Printed Material Processing Method

A method for performing processing such as opening holes with regard to the printed material 5 using the image forming apparatus 100 of embodiment 1 or the processing apparatus 200 of embodiment 200 will be described next as embodiment 3.

The method for processing the printed material 5 in the present embodiment is a method for processing where processing is performed on the printed material 5, where the printed layer 3 is formed on the substrate 1 using the UV ink 2, using the blade 31 and the blade 31 is previously heated to a predetermined temperature Tc according to the glass transition point of the UV ink 2.

FIG. 3A is a cross sectional diagram of an example of the printed material 5 illustrating circumstances where hole opening processing is performed on the printed material 5 using the blade 31 and FIG. 3B is a planar diagram of a punch hole.

The printed material 5 is configured using the substrate 1 and the printed layer 3 which is formed using the UV ink 2 which is applied to the surface of the substrate 1. The printed layer 3 has a two layer configuration with printed layers 3*a* and 3*b* due to the types of the UV ink 2. The printed layer 3*a* is a binder layer for increasing adhesiveness between the substrate 1 and the printed layer 3*b* and is formed using a transparent UV ink 2*a*. The printed layer 3*b* is a color layer for forming the desired image and is formed using a color UV ink 2*b*.

Here, curing (polymerization) of both of the printed layers 3*a* and 3*b* is completed using an ultraviolet irradiating unit (the UV irradiating unit 27 in the case of the image forming apparatus 100). The glass transition point of the printed layer 3*b* which is cured is described below as being Tg (° C.).

The blade 31 is a cylindrical punching blade made from an ultrahard metal for forming a punch hole 9 with a circular shape as shown in FIG. 3B.

FIG. 3C is a planar diagram illustrating cracks and chips in a case where cracks and chips are generated in the punch hole 9. In a technique in the prior art, there are cases where cracks 9*a* and chips 9*b* are generated in the printed layer 3 as damage due to the blade 31 as in the example shown in FIG. 3C. The object of the printed material processing method in the present embodiment is to suppress reductions in processing quality due to such cracking, chipping, and peeling being generated.

First, the blade 31 and the lower punching die 33 are previously heated. In detail, the processing control section 35 heats by controlling the heater units 36 and 37 (FIGS. 1 and 2) based on the glass transition point Tg (° C.) of the printed layer 3*b*. As a preferred example, a temperature Tc of the blade 31 is heated to Tg−5° C. and a temperature Tf of the lower punching die 33 is heated so that the temperature which the printed layer 3 reaches is Tg−5° C.

Here, the temperatures, which the blade 31 and the lower punching die 33 are heated to, is not limited to these temperatures. It is sufficient if the temperature Tc of the blade 31 is in the range of Tg−40° C.<Tc<Tg+10° C. It is more preferable if the temperature Tc of the blade 31 is in the range of Tg−10° C.<Tc<Tg+3° C. In addition, it is sufficient if the temperature Tf of the lower punching die 33 is such that the temperature of the printed layer 3 is a temperature which is less than Tg. It is preferable for an optimal value to be determined by prior investigation.

Next, the printed material 5 is placed at a predetermined position on the lower punching die 33 and is left for a predetermined period of time. In detail, the printed material 5 which is transported by the transport mechanism 50 is set at a predetermined position using the position alignment mechanism of the lower punching die 33. It is sufficient if the period of time over which the printed material 5 is left is a period of time for the printed layer 3 to reach a predetermined temperature due to the lower punching die 33 which is heated and this period of time is determined through prior investigation or the like and is controlled by the processing control section 35.

Here, there may be a configuration where a preheating means is provided in the transport mechanism 50 in order to shorten the period of time over which the printed material 5 is left.

Next, hole opening processing is performed. In detail, the upper punching die 32 (the blade 31) is pressed into the printed material 5 and the punch hole 9 is formed by controlling of driving of the pressing mechanism 34 due to control by the processing control section 35.

Here, since it is possible for the UV ink 2 with various colors to be used as the UV ink 2 which is applied to the surface of the substrate 1, there are cases where the glass transition point Tg (° C.) of the printed layer 3*b* which is cured differs depending on the composition of the UV ink 2 which is used.

FIGS. 4A and 4B are a planar diagram and a cross sectional diagram illustrating an example of a case where an image (the printed layer 3) is formed using the UV inks 2 where the compositions are different.

In a case where a punch hole 9*a* is formed in a printed layer 3*b-a* which is formed using a UV ink 2*b-a* and punch holes 9*b* and 9*c* are formed in a printed layer 3*b-b* which is formed using a UV ink 2*b-b* as shown in FIG. 4A, the heating temperature of the blade 31 which forms the punch holes is optimized for all of the printed layers 3. In detail, out of blades 31*a*, 31*b*, and 31*c* which are each shown in FIG. 4B, the blade 31*a* is heated to a temperature which matches with the glass transition point Tg (° C.) of the printed layer 3*b-a* and the blades 31*b* and 31*c* are heated to a temperature which matches with the glass transition point Tg (° C.) of the printed layer 3*b-b*.

In addition, the printed layer 3 is not limited to the two layer configuration of the binder layer (the printed layer 3*a*) and the color layer (the printed layer 3*b*) and there are cases of configurations with more layers.

FIG. 5 is a cross sectional diagram illustrating a case where the printed layer 3 is formed using three layers. An example is shown of a case where a coating layer (a printed layer 3*c*) is further formed on the binder layer (the printed layer 3*a*) and the color layer (the printed layer 3*b*). The printed layer 3*b-a* and the printed layer 3*b-b* are formed as two layers of the printed layer 3*b* and the printed layer 3*c* is formed on the upper layer. The coating layer (the printed layer 3*c*) is a layer for performing a matting treatment or the like using the transparent UV ink 2.

In the processing of the printed material 5 with this configuration, the blades 31*a* and 31*b* are heated to a temperature which matches with the glass transition point Tg (° C.) of the printed layer 3*c*.

Applied Example

An applied example is described next where hole opening processing was performed on the printed material 5 by changing the temperature of the blade 31 which was previously heated and the processing quality was evaluated.

The members which were used in the evaluation were as follows. The printed layer 3 had a two layer configuration.

Substrate 1 (50 μm): PET (polyethylene terephthalate)

UV ink 2 for binder layer (printed layer 3*a*, 5 μm): glass transition point of approximately 100° C.

UV ink 2 for color layer (color layer 3*b*, 45 μm): glass transition point of approximately 100° C.

Blade 31: ultrahard metal

The evaluation method was as follows.

Heating of the printed material 5 (the printed layer 3) was not performed and the printed material 5 (the printed layer 3) was at room temperature (approximately 25° C.)

The temperature of the blade tip of the blade 31 was heated to each of the temperatures which are shown in Table 1 and the blade tip of the blade 31 was abutted against the surface of the printed material 5 (abutting time of approximately 1.0 seconds).

The blade 31 was pressed and formed a punch hole after the abutting time has elapsed and the blade 31 was immediately separated from the printed material 5, and the outer appearance of the punch hole which was formed was evaluated using a microscope.

The references for the evaluation were as below.

A: No cracks or chips were found

B: Cracks and chips were found to be in a permissible range

C: Cracks and chips were generated

D: Numerous cracks and chips were generated

The heating temperatures for the blade 31 and the evaluation results of the punch holes 9 which were formed are shown in Table 1.

TABLE 1

| | Heating Temperature (° C.) | | | | | | | | |
|---|---|---|---|---|---|---|---|---|---|
| | 40 | 60 | 80 | 90 | 95 | 100 | 103 | 105 | 110 |
| Evaluation Results | D | C | B | A | A | A | A | B | C |

As is understood from Table 1, cracks and chip which were generated at the processing interface were suppressed from being generated by the blade 31 being previously heated to a temperature in the vicinity of the glass transition point Tg of the printed layer 3.

As described above, it is possible to obtain the following effects according to the printed material processing method, the printed material processing apparatus, and the image forming apparatus according to the present embodiments.

First, in the printed material processing method according to the present embodiment, since the blade 31, which processes the printed material 5 where the printed layer 3 is formed, is previously heated to a predetermined temperature according to the glass transition point of the UV ink 2, the processing interface is softened due to heat energy which is transferred due to the blade 31 abutting against the printed layer 3 during processing. For this reason, damage which is imparted onto the fracture surface of the printed layer 3 due to processing is reduced and cracking, chipping, peeling, and the like of the printed layer 3 at the processing location is suppressed. As a result, it is possible to, for example, suppress reductions in processing quality without using the UV inks 2 where the hardness is different and without inviting increases in the costs or size of the image forming apparatus or reductions in printing quality.

In addition, since the blade 31, which processes the printed material 5 where the printed layer 3 is formed, is previously heated to a predetermined temperature according to the glass transition point of the UV ink 2 on the uppermost layer which configures the printed layer 3, the processing interface on the uppermost layer is softened due to heat energy which is transferred due to the blade 31 abutting against the printed layer 3 during processing. For this reason, damage which is imparted onto the processing interface on the uppermost layer due to processing is reduced. As a result, the extent of damage to the printed layer 3 at an inner section due to damage to the processing interface on the uppermost surface being a trigger is suppressed.

In addition, due to Tg−40° C.<Tc<Tg+10° C., damage which is imparted to the fracture surface of the printed layer 3 due to processing is further reduced.

In addition, it is possible to soften the processing surface which abuts against the blade 31 in a shorter period of time by the printed layer 3 being previously heated to a temperature which is less than the glass transition point of the UV ink 2. As a result, it is possible to shorten the period of time over which the blade 31 which is heated is abutting against the printed layer 3, that is, the processing time. In other words, it is possible to reduce damage which is imparted onto the fracture surface of the printed layer 3 and to suppress cracking, chipping, peeling, and the like of the printed layer 3 being generated at the processing location even in a case where the processing is performed at a faster speed.

Next, in the printed material processing apparatus according to the present embodiment, the processing apparatus 200 is provided with the blade 31 which is able to process the printed material 5, the heater unit 36 which is able to heat the blade 31, and the first control section which is able to control the heater unit 36. Since the first control section previously heats the blade 31 to a predetermined temperature according to the glass transition point of the UV ink 2 before processing is performed, the processing interface is softened due to heat energy which is transferred due to the blade 31 abutting against the printed layer 3 during processing. For this reason, damage which is imparted onto the fracture surface of the printed layer 3 due to processing is reduced and cracking, chipping, peeling, and the like of the printed layer 3 at the processing location is suppressed.

In addition, the processing apparatus 200 is further provided with the heater unit 37 which is able to heat the printed layer 3 and the second control section which is able to control the heater unit 37. The second control section previously heats the printed layer 3 to a temperature which is less than the glass transition point of the UV ink 2 using the heater unit 37 before processing is performed. For this reason, it is possible to soften the processing surface which abuts against the blade 31 in a shorter period of time. As a result, it is possible to shorten the period of time over which the blade 31 which is heated is abutting against the printed layer 3, that is, the processing time. In other words, it is possible to reduce damage which is imparted onto the fracture surface of the printed layer 3 and to suppress cracking, chipping, peeling, and the like of the printed layer 3 being generated at the processing location even in a case where the processing is performed at a faster speed.

In addition, in the image forming apparatus of the present applied example, the image forming apparatus 100 is provided with the printing section 20 which is able to form the printed layer 3 on the substrate 1 using the UV ink 2, the blade 31 which is able to process the printed material 5 where the printed layer 3 is formed using the printing section 20, the heater unit 36 which is able to heat the blade 31, and the first control section which is able to control the heater unit 36. That is, it is possible for the image forming apparatus 100 to perform not only printing on the substrate 1 but also perform processing of the printed material 5 which is printed on the substrate 1.

In addition, since the first control section previously heats the blade 31 to a predetermined temperature according to the glass transition point of the UV ink 2 before processing is performed, the processing interface is softened due to heat energy which is transferred due to the blade 31 abutting against the printed layer 3 during processing. For this reason, damage which is imparted onto the fracture surface of the printed layer 3 due to processing is reduced and cracking, chipping, peeling, and the like of the printed layer 3 at the processing location is suppressed.

That is, according to the present embodiment, it is possible to provide the image forming apparatus which is smaller in size and where reductions in product quality of the printed layer 3 due to processing is suppressed.

In addition, the image forming apparatus 100 is further provided with the heater unit 37 which is able to heat the printed layer 3 and the second control section which is able to control the heater unit 37. The second control section previously heats the printed layer 3 to a temperature which is less than the glass transition point of the UV ink 2 using the heater unit 37 before processing is performed. For this reason, it is possible to soften the processing surface which abuts against the blade 31 in a shorter period of time. As a result, it is possible to shorten the period of time over which the blade 31 which is heated is abutting against the printed layer 3, that is, the processing time. In other words, it is possible to reduce damage which is imparted onto the fracture surface of the printed layer 3 and to suppress cracking, chipping, peeling, and the like of the printed layer 3 being generated at the processing location even in a case where the processing is performed at a faster speed.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printed material processing method, comprising:

performing a processing by using a blade on a printed material where a printed layer is formed on a resin substrate, which is a printing medium, using an ultraviolet curable material; and heating the blade before the performing of the processing, wherein the heating of the blade includes previously heating the blade to a predetermined temperature Tc (° C.) according to a glass transition point of the ultraviolet curable material before the performing of the processing, and wherein when the glass transition point is Tg (° C.), the predetermined temperature Tc (° C.) is Tg−40° C.<Tc<Tg+10° C.

2. The printed material processing method according to claim 1, wherein the glass transition point is the glass transition point of the ultraviolet curable material on an uppermost layer which forms the printed layer.

3. A printed material processing method, comprising:

performing a processing by using a blade on a printed material where a printed layer is formed on a resin substrate, which is a printing medium, using an image forming material; and previously heating the blade to a predetermined temperature Tc (° C.) according to a glass transition point of the image forming material before the performing of the processing, wherein when the glass transition point is Tg (° C.), the predetermined temperature Tc (° C.) is Tg−40° C.<Tc<Tg+10° C.

4. The printed material processing method according to claim 3, wherein the glass transition point of the image forming material is the glass transition point of the image forming material on an uppermost layer which forms the printed layer.

5. The printed material processing method according to claim 1, wherein when the glass transition point is Tg (° C.), the predetermined temperature Tc (° C.) is Tg−10° C.<Tc<Tg+3° C.

6. The printed material processing method according to claim 1, further comprising previously heating the printed layer to a temperature which is less than the glass transition point before the performing of the processing.

7. A printed material processing apparatus configured to process a printed material where a printed layer is formed on a resin substrate, which is a printing medium, using an ultraviolet curable material, the printed material processing apparatus comprising:

a blade configured to perform a processing of the printed material;

a first heating section configured to heat the blade; and a first control section configured to control the first heating section, the first control section being further configured to heat the blade using the first heating section before the processing is performed, wherein the blade is previously heated to a predetermined temperature Tc (° C.) according to a glass transition point of the ultraviolet curable material before the processing is performed, and wherein when the glass transition point is Tg (° C.), the predetermined temperature Tc (° C.) is Tg−40° C.<Tc<Tg+10° C.

8. A printed material processing apparatus configured to process a printed material where a printed layer is formed on a resin substrate, which is a printing medium, using an image forming material, the printed material processing apparatus comprising:

a blade configured to perform a processing of the printed material;

a first heating section configured to heat the blade; and a first control section configured to control the first heating section, the first control section being further configured to previously heat the blade to a predetermined temperature according to a glass transition point of the image forming material using the first heating section before the processing is performed, wherein when the glass transition point is Tg (° C.), the predetermined temperature Tc (° C.) is Tg−40° C.<Tc<Tg+10° C.

9. The printed material processing apparatus according to claim 7, further comprising a second heating section configured to heat the printed layer, and a second control section configured to control the second heating section, the second control section being further configured to previously heat the printed layer to a temperature which is less than the glass transition point using the second heating section before the processing is performed.

10. An image forming apparatus comprising:

a printing section configured to form a printed layer on a resin substrate, which is a printing medium, using an ultraviolet curable material;

a blade configured to perform a processing of the printing medium where the printed layer is formed;

a first heating section configured to heat the blade; and a first control section configured to control the first heating section, the first control section being further configured to heat the blade before the processing is performed, wherein the blade is previously heated to a predetermined temperature Tc (° C.) according to a glass transition point of the ultraviolet curable material before the processing is performed, and wherein when the glass transition point is Tg (° C.), the predetermined temperature Tc (° C.) is Tg−40° C.<Tc<Tg+10° C.

11. The image forming apparatus according to claim 10, further comprising a second heating section configured to heat the printed layer, and a second control section configured to control the second heating section, the second control section being further configured to previously heat the printed layer to a temperature which is less than the glass transition point before the processing is performed.

12. An image forming apparatus comprising:

a printing section configured to form a printed layer on a resin substrate, which is a printing medium, using an image forming material;

a blade configured to perform a processing of the printing medium where the printed layer is formed;

a first heating section configured to heat the blade; and a first control section configured to control the first heating section, the first control section being further configured to heat the blade to a predetermined temperature according to a glass transition point of the image forming material before the processing is performed, wherein when the glass transition point is Tg (° C.), the predetermined temperature Tc (° C.) is Tg−40° C.<Tc<Tg+10° C.

13. The image forming apparatus according to claim 12, further comprising a second heating section configured to heat the printed layer, and a second control section configured to control the second heating section, the second control section being further configured to previously heat the printed layer to a temperature which is less than the glass transition point of the image forming material before the processing is performed.

* * * * *